United States Patent [19]

Levinson

[11] 4,124,956

[45] Nov. 14, 1978

[54] CUTTING SYSTEM WITH DEBRIS VACUUMING MEANS

[76] Inventor: Lewis R. Levinson, 23 Sandstone La., Willingboro, N.J. 08046

[21] Appl. No.: 818,176

[22] Filed: Jul. 22, 1977

[51] Int. Cl.[2] ..... B24B 23/00; B24B 55/06

[52] U.S. Cl. ..... 51/273; 51/170 PT

[58] Field of Search ..... 51/273, 170 PT, 170 R; 30/133, 124, 166

[56] References Cited

U.S. PATENT DOCUMENTS

| | | | |
|---|---|---|---|
| 994,430 | 6/1911 | Tunks | 51/273 X |
| 3,126,021 | 3/1964 | May | 51/273 X |
| 3,217,407 | 11/1965 | Azar | 30/133 |
| 3,975,821 | 8/1976 | Flicker | 30/133 |

FOREIGN PATENT DOCUMENTS

| | | | |
|---|---|---|---|
| 695,877 | 10/1930 | France | 30/133 |
| 930,986 | 9/1947 | France | 30/166 |

*Primary Examiner*—Jimmy C. Peters

*Attorney, Agent, or Firm*—Caesar, Rivise, Bernstein & Cohen, Ltd.

[57] ABSTRACT

A combined cutting and vacuum apparatus comprising a cutting device having a vacuum shroud and a remote housing having a vacuum motor disposed therein. A flexible drive shaft powers the cutting device from the motor and a flexible vacuum tube produces a vacuum at the shroud. The motor includes a rotary drive shaft having a first end portion on which an impeller is secured and to which the flexible drive shaft is connected. A vacuum chamber is provided in the housing over the impeller and the rotary shaft extends therethrough. The vacuum chamber has an inlet port laterally offset from the rotary shaft. A removable filter bag is mounted within the housing between the port and the vacuum tube.

In one embodiment the cutting device includes a handpiece having a rotary bur. The shroud is a tubular member having a flared open mouth. The handpiece is releasably secured within the shroud, with the abrading bur extending from the interior of the shroud to slightly outside the flared mouth. A coupling communicates with the interior of the free end of the shroud and extends at an angle thereto to connect the vacuum tube to the shroud so that the vacuum produced by the motor effects the withdrawl of the material abraded by the bur into the shroud through the vacuum tube and into the filter for entrapment therein.

In another embodiment the cutting device includes an elongated saw blade having an arcuate cutting edge. The blade is releasably secured to the cutting device and arranged for oscillatory motion through a predetermined length stroke. The stroke length is readily adjustable. A vacuum shroud is provided and includes a slot through which the arcuate cutting edge of the blade extends. The vacuum tube coupling communicates with the interior of the slot in the shroud and is readily disconnectible from the cutting device. The shroud includes adjustable means for establishing the depth of the cut produced by the oscillatory blade.

10 Claims, 13 Drawing Figures

FIG. 1
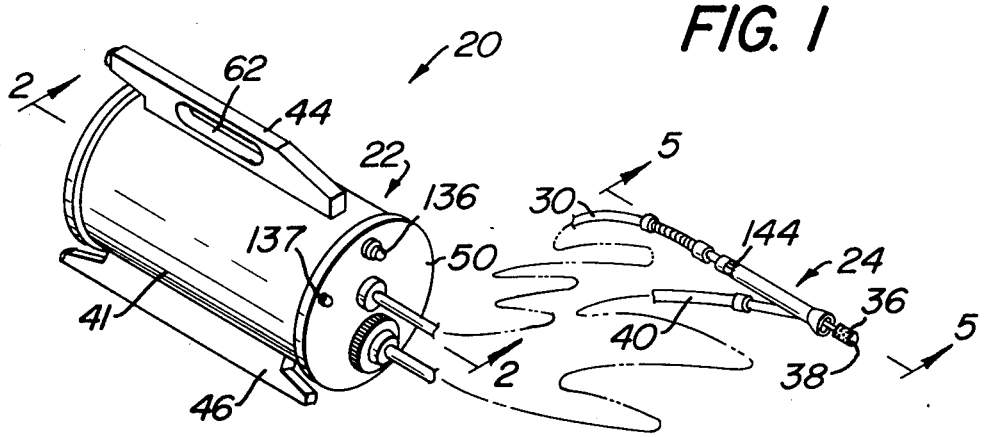
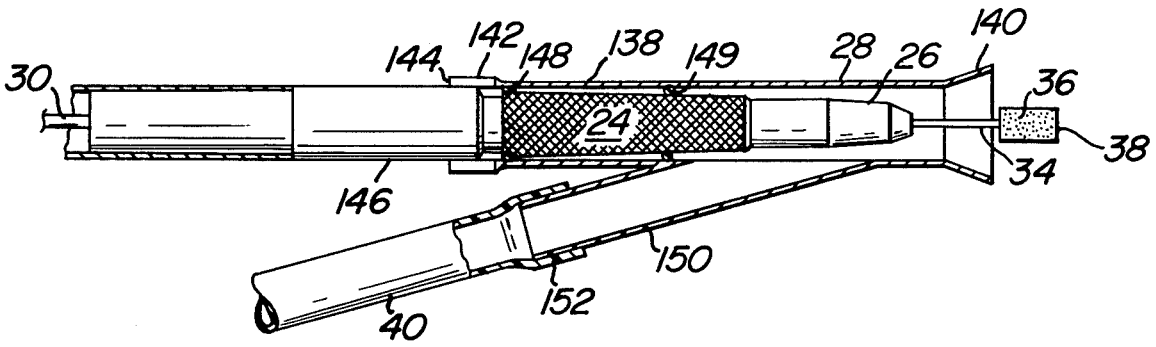
FIG. 5

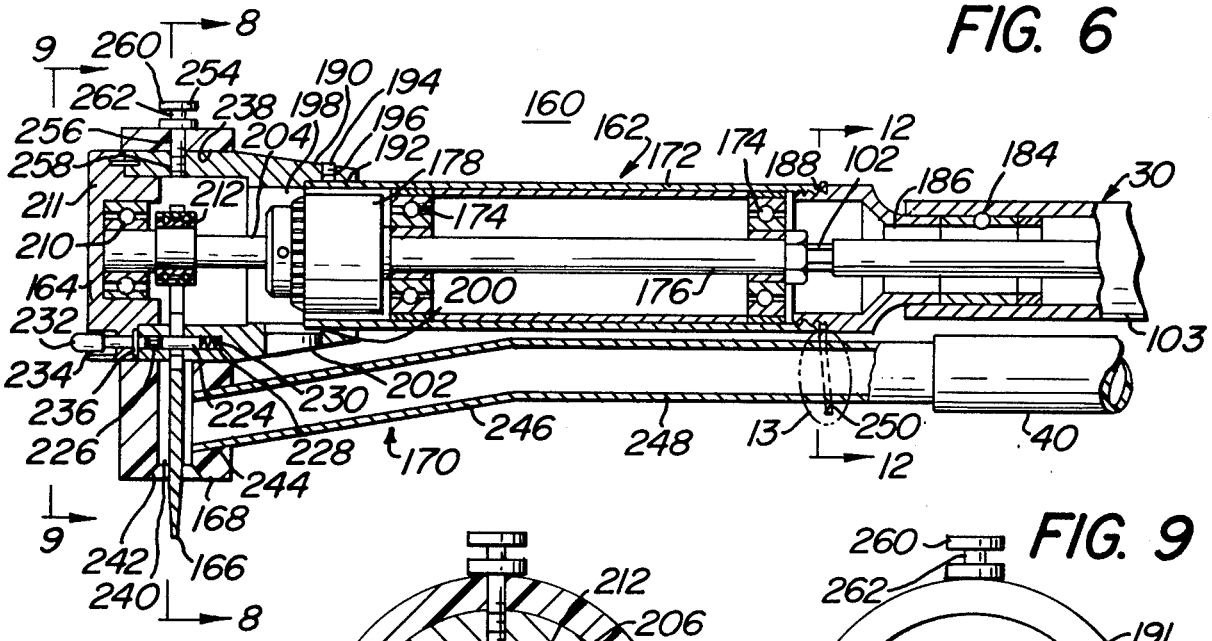
FIG. 6
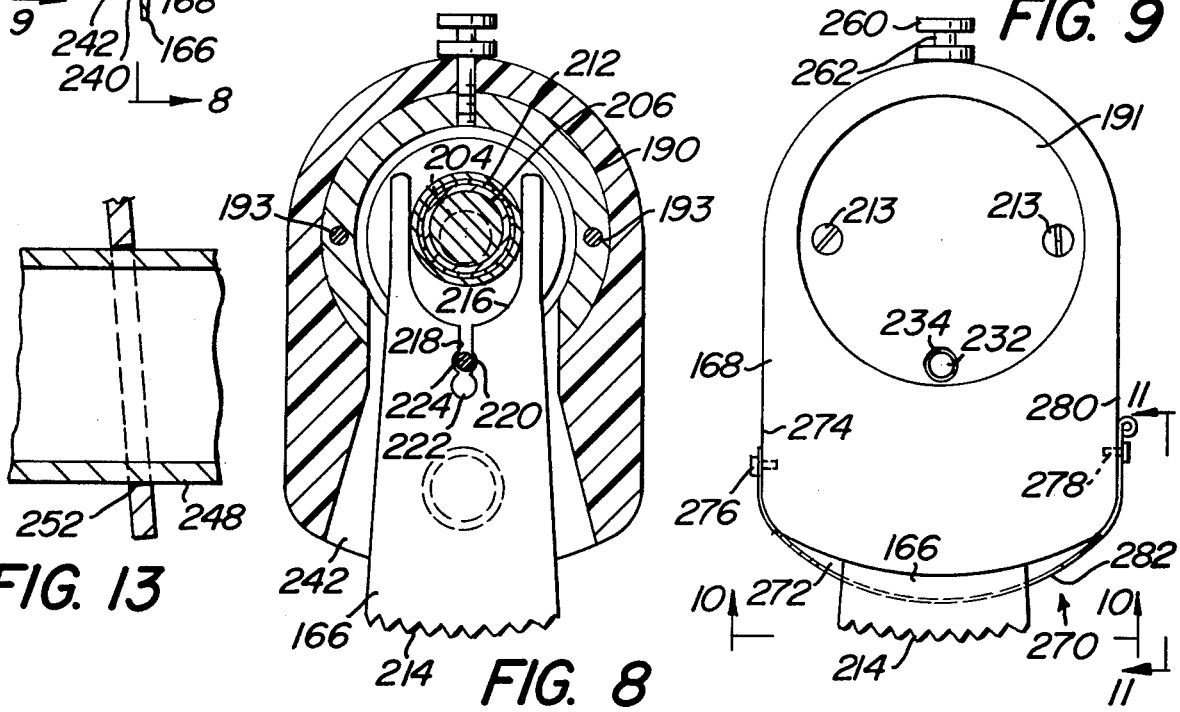
FIG. 9
FIG. 13
FIG. 8
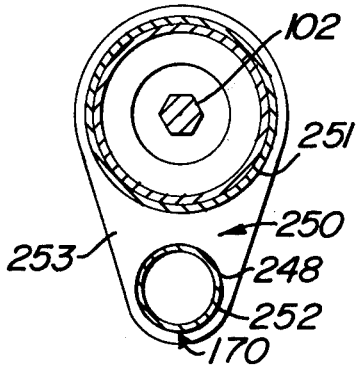
FIG. 12
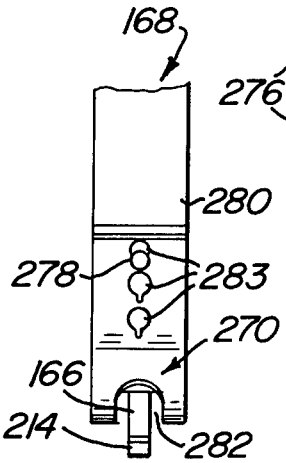
FIG. 11
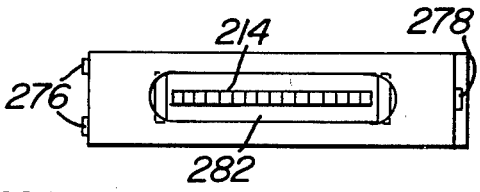
FIG. 10

CUTTING SYSTEM WITH DEBRIS VACUUMING MEANS

This invention relates generally to cutting and debriding apparatus and more particularly to medical apparatus for cutting and debriding and having associated vacuum means for collecting debris produced during the cutting or debriding operation.

Cutting and/or debriding apparatus are frequently utilized in the medical and podiatric arts, such as for removing casts, cutting bone, debriding tissue, nails, corns, calluses, etc. During such operations substantial amounts of debrided material in the form of minute particles of dust are formed and rendered airborne. Such dust eventually settles all over the room and on the personnel therein, an obviously undesirable action. More importantly, airborne dust poses both ocular and respiratory hazards to exposed personnel. Accordingly, it is a common practice during cast cutting or debriding operations for operating personnel to wear protective face coverings or masks.

It has been proposed in the patent literature to utilize a vacuum means in conjunction with the cutting operation to effect the removal of the debrided material as it is produced, thereby precluding it from becoming airborne. Examples of prior art bone or cast cutters or tissue debriding apparatus and including vacuuming features are found in U.S. Pat. Nos. 3,104,069 (Gary), 3,126,021 (May) and 3,214,869 (Stryker).

While such devices are certainly a step in the right direction to preclude minute dust particles from being rendered airborne, still they leave much to be desired from the standpoint of simplicity of construction and operation and adaptability for various cutting or debriding applications.

In the Gary patent there is disclosed a vacuumized cast cutting device in the form of a handpiece with a motor for rotating a rotary cutting blade. The motor also creates a vacuum within a hood which covers a portion of the blade. A bag for collecting debrided material is disposed at the posterior end of the handpiece. The inclusion of the motor within the handpiece appears to render the device relatively bulky and may limit or preclude its use or effectiveness for applications requiring wide mobility.

In the May patent there is disclosed a grinding device comprising a housing having a passage therethrough and terminating in a flared opening within a semi-circular vacuum hood. The hood is formed of a transparent material to serve as a magnifying lens. A groove is provided in the housing for holding a conventional handpiece which terminates in a rotary bur such that the bur is disposed under the vacuum hood. The passageway in the housing is adapted to be connected to any source of vacuum, e.g., a conventional vacuum cleaner, while the handpiece would appear to be powered in the conventional manner by separate means from the vacuum source. This feature renders the system of the May patent relatively complex.

In the Stryker patent there is disclosed a combined abrading and vacuuming device in the form of a housing including a vacuum motor with a filter bag disposed thereover. A drive shaft from the motor extends through holes in the filter bag and out the housing through a vacuum tube to a remotely located cutting device. The cutting device includes a circular blade, a portion of which is disposed within a vaccum hood to which the vacuum tube is connected. The drive shaft exits the vacuum tube at the end of the cutting device, with the remaining portion of the vacuum tube forming an arcuate portion or loop to the vacuum hood. Owing to the construction of the Stryker device it would appear to have several disadvantageous features. For example, changing of the filter bag is rendered somewhat difficult since the drive shaft extends through it. In addition, the debrided material drawn within the bag by the operation of the device appears susceptible to egress through the drive shaft openings in the bag and into the motor, which action may impede operation or result in a malfunction. Furthermore, the loop of the vacuum tube to the cutting head hood may impede or otherwise render difficult the movement and orientation of the cutting head during operation of the device.

Other prior art patents related to combinations of abrading, cutting or scrubbing devices with vacuuming means are as follows: U.S. Pat. Nos. 1,093,049 (Hawley), 1,810,336 (Bennington), 2,956,546 (Teters et al) and 3,013,293 (Schottle).

It is a general object of the instant invention to overcome the disadvantages of prior art cutting and abrading devices.

It is a further object of the instant invention to provide a cutting and debriding system which is simple in construction and suitable for a wide variety of applications.

It is still a further object of this invention to provide a cutting and debriding system which is effective for trapping dust produced during the cutting or debriding operation.

It is yet a further object of this invention to provide a vacuum shroud for use with conventional rotary handpieces for effecting the removal of debrided material produced by the operation of said handpiece.

It is yet a further object of this invention to provide a cast cutting head which is simple in construction, can be readily adjusted and includes provision for connection to a vacuum source to remove abraded material produced during the cutting operation.

These and other objects of the instant invention are achieved by providing a combined cutting and vacuum apparatus comprising a cutting device having a vacuum shroud and a remote housing. The housing includes a vacuum motor disposed therein. A flexible drive shaft powers and cutting device from the motor. A flexible vacuum tube is provided for producing a vacuum at the shroud. The motor includes a rotary shaft having a first end portion on which an impeller is secured and to which the flexible drive shaft is connected. The housing also includes a vacuum chamber mounted over the impeller with a portion of the rotary shaft extending therethrough. The vacuum chamber includes an inlet port laterally offset from the rotary shaft. Removable filter means are mounted within the housing between the port and the vacuum tube. The cutting device includes a cutting tool. The shroud is disposed over the cutting tool and in communication with the vacuum tube.

In one embodiment of the instant invention the shroud is a tubular member having an open flared mouth. A cutting device is releasably secured within the shroud with its cutting or abrading bur extending slightly out of the flared mouth. The shroud includes a vacuum tube coupling communicating with the interior of the free end and extending at an angle thereto to connect the vacuum conduit to the shroud so that the vacuum produced by the motor effects the withdrawl of the material abraded by the bur into the shroud, through the vacuum conduit and into the filter for entrapment therein.

In accordance with another embodiment of the instant invention the cutting device includes an elongated saw blade having an arcuate cutting edge, the blade is releasably secured to the cutting device and arranged for oscillatory motion through a predetermined length stroke, the length of the stroke is readily adjustable. A vacuum shroud is provided on the cutting device and includes a slot through which the arcuate cutting edge of the blade extends. A vacuum tube coupling is provided communicating with the interior of the slot and with the vacuum tube to the motor unit. The coupling is readily disconnectible from the cutting device.

Other objects and many of the attendant advantages of this invention will be readily appreciated as the same becomes better understood by reference to the following detailed description when considered in connection with the accompanying drawing wherein:

FIG. 1 is a perspective view of one embodiment of the apparatus of the instant invention;

FIG. 5 is an enlarged sectional view taken along line 5—5 of FIG. 1;

FIG. 6 is a sectional view of an alternative embodiment of the instant invention;

FIG. 8 is an enlarged sectional view taken along line 8—8 of FIG. 6;

FIG. 9 is an enlarged end view taken along line 9—9 of FIG. 6;

FIG. 10 is a view taken along line 10—10 of FIG. 9;

FIG. 11 is a view taken along line 11—11 of FIG. 9;

FIG. 12 is a sectional view taken along line 12—12 of FIG. 6; and

FIG. 13 is an enlarged view of a portion of the device shown in FIG. 6.

Figure 2:
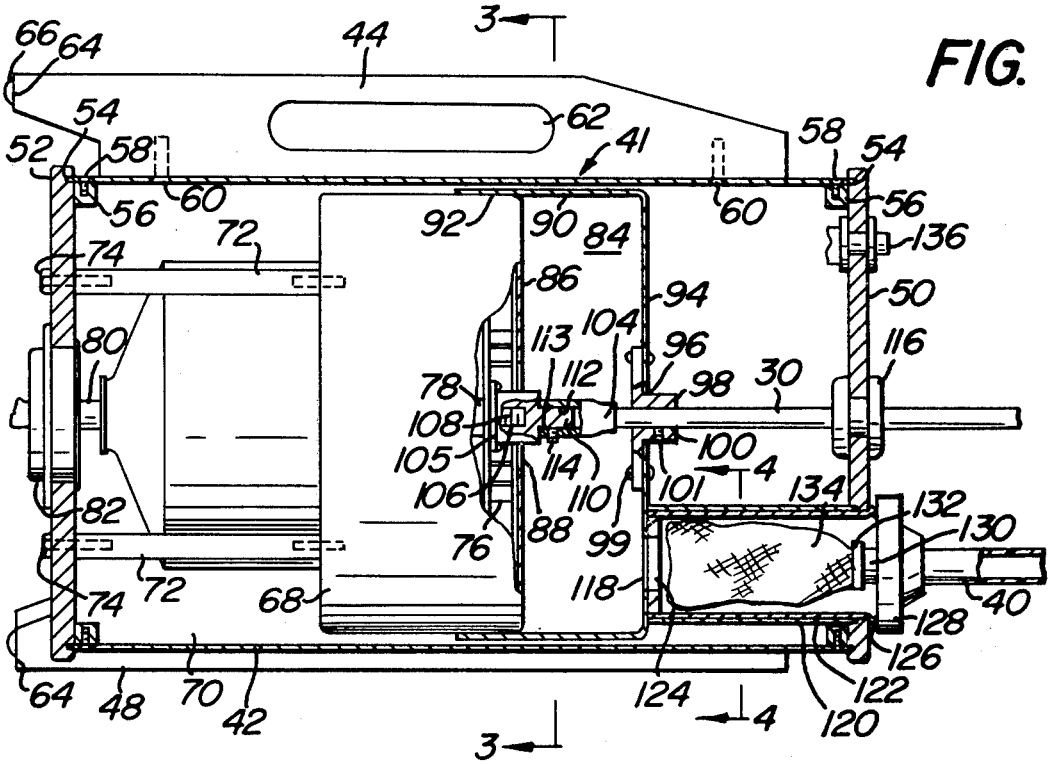
FIG. 2 is an enlarged sectional view taken along line 2—2 of FIG. 1.
Figure 3:
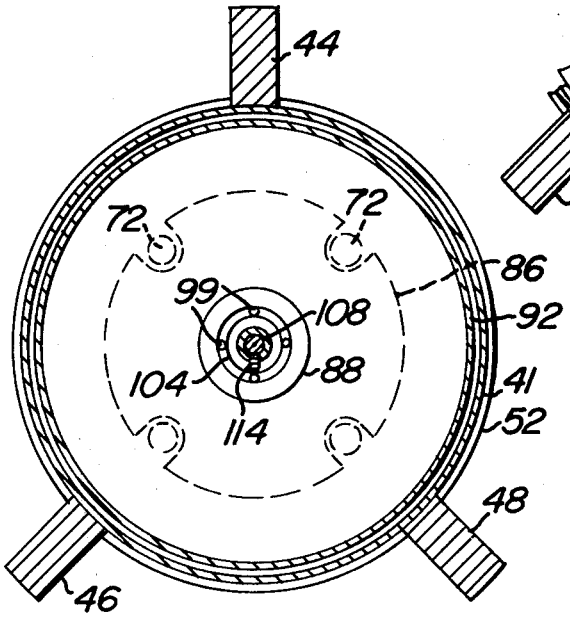
FIG. 3 is a sectional view taken along line 3—3 of FIG. 2.
Figure 4:
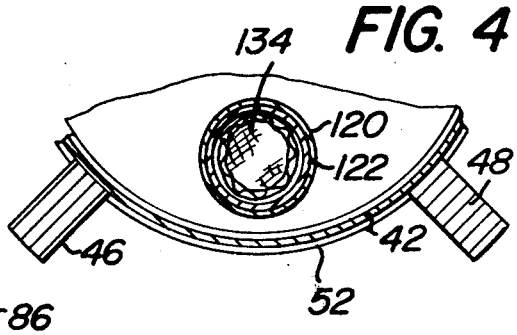
FIG. 4 is a sectional view taken along line 4—4 of FIG. 2.

Referring now in greater detail to the various figures of the drawing wherein like reference characters refer to like parts, a combined cutting and debris dust removal system in accordance with one aspect of this invention is shown generally at 20 in FIG. 1. The system 20 shown in FIG. 1 is particularly adapted for debriding operations such as carried out in the practice of podiatry.

The system 20 basically comprises a motor unit 22 and a remotely located abrading device 24. The abrading device comprises a handpiece 26 located within the interior of a vacuum shroud 28. The handpiece is arranged to rotate an abrading tip or bur at a high rate of speed and is of conventional construction. The handpiece is driven, via a flexible drive shaft 30, from the motor unit 22. The motor unit, as will be described in detail later, in addition to powering the abrading device, also produces a vacuum at the vacuum shroud to draw the debrided material or dust into the shroud and through a vacuum tube 40 to the motor unit 22 for entrapment therein during operation of the abrading device.

The handpiece 26 includes a chuck or collet, shown generally by the reference numeral 32 in which the shank 34 of a conventional abrading bur 36 is disposed. The bur includes a working end 38 which may be roughened, segmented, toothed, etc., in accordance with conventional practice.

The vacuum shroud 28 of the instant invention is suitable for holding various types of conventional handpieces of similar dimensions therein. One particularly effective handpiece suitable for use within the shroud 28 is sold by the Foredom Electric Company of Bethel, Connecticut as its Model 7D. The flexible drive shaft 30, as will be seen in detail later, is also of conventional construction. The Series B FLEXADE flexible shaft of the Foredom Electric Company is also particularly suitable for use in the instant system.

As can be seen in FIG. 2, the motor unit 22 basically comprises a housing 41 in the form of a cylindrical shell 42 (FIG. 2). Three legs 44, 46 and 48 are mounted on the exterior surface of the shell 42. Each of the legs is a longitudinally extending member, projecting generally radially from the shell. The shell includes a front wall 50 and a rear wall 52. The walls 50 and 52 are mounted on the opposed ends of the shell 42, via the insertion of the peripheral edges of the shell within respective annular grooves 54 in the interior faces of the walls 50 and 52. Plural mounting tabs 56 project inward from the inside surfaces of the walls 50 and 52 and each are adapted to receive a threaded fastening member, such as screw 58 therein. The screws extend through aligned openings in the walls of the shell. Each of the legs 44, 46 and 48 is mounted on the shell, via a pair of screws 60.

The legs 44–48 are arranged to support the motor unit 22 in a horizontal position on the ground. As can be seen in FIGS. 1 and 2, the leg 44 includes an elongated opening 62 to serve as a handle for transporting the apparatus 20.

As can be seen in FIG. 2, the ends of the legs 44, 46 and 48, denoted by the reference numeral 64, are co-planar and each includes a caster 66 mounted thereon. Accordingly, the motor 22 is also adapted to be supported in a vertical orientation with the casters 66 making contact with the ground.

As can be seen in FIG. 2, an electric motor 68 is mounted within the hollow interior 70 of the motor unit 22. To that end, the motor is mounted on the rear wall 52 by plural elongated standoffs 72. The standoffs are secured to the wall via threaded bolts 74. The motor 68 is of a conventional construction and is of the type commonly utilized in vacuum cleaners. To that end, it includes an impeller 76 mounted on a rotary shaft 78 of the motor. While any type of conventional vacuum motor may be utilized, it has been found that one particularly effective motor is sold by the Lamb Electric Division of Ametek under the designation Thru-Flow Vacuum Motor. Electric power for the motor 68 is provided via a power cord 80 extending through a grommet 82 in the rear wall 52.

A vacuum chamber 84 is mounted on the shell 86 of the motor and over the impeller 76. The motor shell 86 includes a central opening 88 communicating with the interior of the vacuum chamber 84. The vacuum chamber is formed as a bowl-shaped member having a circular side wall 90, whose inner periphery 92 is connected to the motor shell 86 and a flat end wall 94. The end wall 94 includes a central opening 96 in which a shaft flange 98 is mounted by fasteners 99. The flange 98 includes a central opening 100 through which one end portion of the flexible drive shaft 30 extends. The flexible drive shaft is held in place by a set screw 101.

As can be seen in detail in FIG. 6, the drive shaft 30 includes a central flexible shaft 102 within a tubular sleeve 103 (FIG. 6). At the end of the flexible drive shaft which is connected to the motor unit 22 there is mounted a drive shaft coupler 104 which is in turn connected, via a motor unit coupler 105, to the rotary shaft 78 of the motor. The motor unit coupler 105 basically comprises a threaded central opening 106 into which a threaded portion 108 of the rotary motor shaft 78 extends. A projection 110 extends outward from the coupler 105 co-axially with the threaded opening 106 and is received within a bore 112 in the shaft coupler 104 of the flexible drive shaft 30. The projection includes a flatted surface 113. A set screw 114 extends through an opening in the end portion of the drive shaft contiguous with the bore 112 and into abutment with the flatted surface 113 of the projection 110 to firmly secure the end of the drive shaft 30 to the coupler 105 and hence to the rotary shaft 78 of the motor 68. The flexible drive shaft 30 extends through a grommet 116 in the front 50 of the motor unit housing.

As can be seen in FIG. 2, the vacuum chamber 84 includes an opening or port 118 which is laterally offset from the opening 100 through which the flexible drive shaft 30 extends. The port 118 serves as the inlet to the vacuum chamber when the motor is operating, as will be described in detail later.

In accordance with a preferred aspect of this invention filter means are provided to trap dust laden air drawn through vacuum tube 40 into the vacuum chamber 84 within housing 41. To that end, a sleeve 120 is mounted between the end wall 94 of the vacuum chamber and the front wall 50 of the housing 41. Disposed within the sleeve is a removable cannister assembly 122. The cannister assembly 122 is in the form of a cylindrical can having an opening 124 in its bottom wall communicating with port 118. The front end of the can 122 is threaded at 126. A cap 128 is screwed onto the threaded portion 126. The end of vacuum tube 40 is connected to the cap 128, via a coupling 130, and is in communication with the interior of the can 122. The coupling includes an internally disposed flanged lip 132. A disposable, air pervious, filter bag 134 is mounted, via its mouth, on the flanged lip 132 of the cap 128.

As can be seen in FIG. 1, the front wall 50 of the housing 41 includes an on/off, speed control switch 136 which is connected to the motor 68. Solid state control means (not shown) is mounted within the housing 41 and connected to switch 136 for adjusting the speed of the motor. An indicator lamp 137 is mounted on the front wall 50 to indicate when the system is engaged.

Operation of the system described heretofore is as follows: upon the energization of motor 68, by the actuation of the on/off switch 136, the motor 68 commences rotating. The rotation of the motor accomplishes two functions, namely, the rotation of the flexible drive shaft 30, via the coupling 104, and also the creation of a vacuum within vacuum chamber 84, via the rotation of the impeller 76. The rotation of flexible drive shaft 30 is coupled, via the drive shaft 30, to the handpiece 26 for effecting the rotation of the bur 36 mounted therein. The vacuum produced by the operation of the motor serves to draw debrided material into the vacuum shroud 28, through the communicating vacuum tube 40 into the disposable filter 134 within the cannister 122. The material is trapped within the filter bag 134 while the filtered air passes through the opening 124 in the bottom wall of the cannister, through the communicating port 118 of the vacuum chamber and out an air vent (not shown).

As should be appreciated from the foregoing, the motor unit 22 of the instant invention has various advantageous features, such as its lightweight and compact design and its ability to be operated in various orientations, e.g., horizontal, vertical, etc., thereby offering great operating flexibility. In addition, the filtering system precludes the ingress of dust into the motor while being suitable for ready removal and replacement of its filter medium without necessitating disassembly of the motor unit.

The vacuum shroud 28 shown in FIG. 1 is simple in construction and assures that there is an efficient vacuum intake at the work area of the cutting bur. In addition, the shroud can be readily removed for cleaning and maintenance of the rotary handpiece 26. Reference will now be made to FIGS. 1, 5 and 6 for the details of the construction of the vacuum shroud 28.

As can be seen, shroud 28 is an elongated tubular portion 138 terminating in one end in a flared mouth 140 and at the other end in a thickened wall portion 142. A plurality of longitudinally extending slots 144 are provided equidistantly spaced about the periphery of the enlarged thickness portion 142. The portion 142 with its longitudinlly extending slots 144 serves as a fitting for the press-fit accommodation of a rear portion 146 of handpiece 26 therein to hold the vacuum shroud on the handpiece. A pair of O-rings 148 and 149 are disposed within the hollow interior of the tubular portion 138 at spaced locations to center the handpiece within the vacuum shroud. The rings also preclude the ingress of dust into the rear portion of the vacuum shroud. A vacuum tube coupling 150 in the form of a tubular extension projects toward the rear of the shroud 28 and at an acute angle to the longitudinal axis of the tubular portion 138. The coupling 150 communicates with the interior of tubular portion 138 adjacent to the flared mouth 140 of the shroud 28. The end of the coupling 150 is press-fit within the end 152 of the flexible vacuum tube 40. In accordance with a preferred embodiment, the shroud 28 is formed of metal, such as stainless steel, in the interests of hygiene.

The angularly extending vacuum tube coupling 150 serves to facilitate the use of the abrading device by providing a relatively unimpeded line of sight to the bur. In addition, the angularly extending coupling facilitates the comfortable handling of the vacuum shroud by the operator without interference from the vacuum hose 40.

As will be appreciated by those skilled in the art, the flared mouth 140 of the vacuum shroud, being disposed entirely about the cutting bur end 38 and closely adjacent thereto, provides a wide vacuum sweep to expedite the withdrawl of all the debrided material produced by the cutting action of the bur.

The press-fitting formed by the slotted end of the shroud and the frictionally engaged O-rings enable the vacuum shroud to be readily disconnected from the handpiece without the need for special tools or techniques by merely pulling the shroud and the handpiece apart. Reassembly is just as quick and easy.

Figure 7:
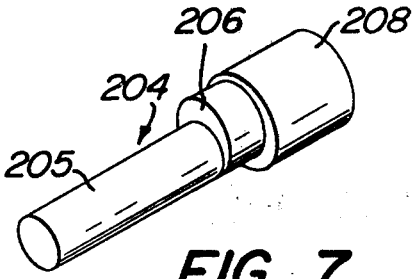
FIG. 7 is an enlarged perspective view of a portion of the device shown in FIG. 6.

In FIG. 7 there is shown a cast cutting apparatus in accordance with another embodiment of this invention. The apparatus is denoted generally by the reference numeral 160 and is adapted to be readily connected to the motor unit 22 in lieu of the hand piece 26 and shroud 28 via the flexible drive shaft 30 and the vacuum tube 40.

The cast cutter 160 basically comprises a handpiece assembly 162, a cutting head 164 including an oscillating blade 166 disposed within a vacuum shroud 168 and a vacuum tube coupler 170. The handpiece assembly 162 is of conventional construction and basically comprises a hand grip sleeve 172 in which a pair of grease-sealed ball bearings 174 are disposed and which journal a drive shaft 176. Disposed at one end of the drive shaft 176 and within sleeve 172 is an adjustable, key-type chuck 178. A retaining nut 180 is mounted on the rear end of the shaft 176 to hold it in place. The shaft 176 is connected to the flexible drive shaft 30. To that end, the flexible drive element of shaft 30 is connected to the drive shaft 176 of the handpiece assembly 162 at nut 180. The sleeve 103 of the drive shaft 30 is frictionally engaged over a spring biased ball lock 184 of a connector 186 of the handpiece assembly 162. The connector 186 is secured to the hand grip sleeve 172, via mating threads 188 at the rear end of the sleeve.

One particularly effective embodiment of the handpiece assembly 162 is sold by the Foredom Electric Company as its Model 30 unit.

The cutting head 164 is mounted at the chuck end of the handpiece assembly 162. To that end, the cutting head comprises a hollow housing 190 including an opening 192 adapted to receive hand grip sleeve 172 therein. The cutting head housing 190 is held in place on the hand grip sleeve, via a set screw 194, extending through an opening 196 in the head and into abutment with the underlying sleeve 172. The head 190 includes a hollow interior 198 in which the chuck 178 of the handpiece assembly is disposed. An opening 200 is provided in the bottom of the head 190 and communicating with the interior 198 thereof. The opening 200 serves as a means for providing access to the chuck key to open and close the chuck 178. A plastic cap or plug 202 is frictionally fit within opening 200 to seal the opening. The plug 202 is removable when access to the interior of the head 190 is desired. The blade 166 is an elongated, flat member which oscillates through a short arc by the rotation of the chuck 178. The rotary motion of the chuck is converted into the oscillatory motion, via means to be described hereinafter. Such means comprises a shaft 204 having a small diameter portion 205 (FIG. 7) mounted within the mouth of chuck 178 and including a larger diameter mid-portion 206 whose axis is is offset from the axis of portion 205 and a large free end portion 208. The free end portion 208 is co-axial with the portion 205 and is mounted within a ball bearing assembly 210. The ball bearing assembly is mounted within a cap 211 on the head 190. The cap is slip fit over the hollow end of head 190 and is held in place by recessed screws 213.

As will be appreciated by those skilled in the art, the rotation of shaft 204 about its longitudinal axis causes portion 206 to operate as a rotating cam. A bearing sleeve 212 is mounted on the shaft 204 about the offset cam portion 206 to couple the cam's rotation to the blade as will be described in detail later.

Referring now to FIG. 8, it can be seen that the blade 166 is an elongated member having an arcuate cutting edge 214 disposed at one end thereof and a U-shaped yoke 216 at the other end. At the root of the yoke is a longitudinally extending slot 218. Plural locating holes 220 and 222 are provided in the slot. Each of the holes establishes a respective pivot point about which the blade can pivot to produce the oscillatory motion. To that end, the blade 166 is mouned on a pivpt pin 224, whose construction will be described in detail later, with the cam bearing sleeve 212 disposed snugly within the U-shaped yoke 216 of the blade.

As will be appreciated by those skilled in the art, the rotation of shaft portion 206 causes the cam bearing sleeve 212 to rotate eccentrically about the longitudinal axis of the drive shaft 176. This action causes the blade 166 to oscillate back and forth about the pivot pin 224. The length of the stroke of the oscillation of blade 166 can be changed by positioning the blade such that the pivot pin 224 lies within either locating hole 220 or locating hole 222. In the former case the length of the stroke of the blade is larger than in the latter case.

It should be pointed out at this juncture that the slot 218 can include as many locating holes as is desired to establish various length cutting strokes.

In order to enable the blade to be mounted on the pivot pin and with the cam bearing sleeve 212 within its yoke 216 the pivot pin includes an undercut portion, to be described in detail hereinafter, whose diameter is smaller than the diameter of either of the holes 220 and 222 in the slot 218. To that end, as can be seen in FIG. 6, the pivot pin 224 is a rod-like element having a chamfered undercut medial portion 226 of smaller cross-sectional area than the remaining portion of the pin. The pin is located within a longitudinally extending bore 228 in the side wall of the head 190. A compression spring 230 is located within the bore hole between the bottom of the pin 224 and the bottom of the bore hole. The pin is arranged for longitudinal displacement within the bore hole such that the undercut portion 226 can be located within the slot 218 in the blade. To that end, the free end of the pin includes an enlarged head 232 located within an enlarged throat portion 234 in the bore 228. A retaining C-washer 236 encircles the pin 224 to preclude its removal from bore 228. The spring 230 is so biased that in the normal position the pin is in the extended position shown in FIG. 7 whereupon the larger diameter cross-sectional area portion of the pin is within one of the locating holes in the slot 218 of the blade. When it is desired to remove the blade from the head assembly or to move the blade to a new position on the pivot pin to establish a new stroke length the head 232 of the pin is depressed, thereby overcoming the biasing of the spring 230, whereupon the reduced cross-sectional area portion 226 is moved to the position within the slot 218. The blade is then moved to the desired location and the pivot pin head released, whereupon the biasing spring moves the pin to the position shown in FIG. 6, thereby locking the blade in place in its new position.

The vacuum shroud 168 is in the form of a disc-like member having a central opening 238 through which the cylindrical head 190 extends and a radially extending slot 240 in communication with the hollow interior 198 of the head. The slot is of channel-like configuration having a flared mouth 242 through which the cutting edge 214 of the blade 166 extends. An angularly extending port 244 is provided within one of the side walls of the shroud 168 and communicates with the slot 240. The port 244 is adapted to receive therein the angularly extending end 246 of the vacuum coupling 170. The other end of the vacuum coupling, denoted by the reference numeral 248, extends through a locking member 250, to be described in detail hereinafter, and is frictionally fit within the hollow interior of the flexible vacuum tube 40. The locking member 250 is in the form of a plate having a central opening 251 (FIG. 12) and is mounted, via said opening, between the hand grip sleeve 172 and the connector 186. The plate 250 includes a projecting tab portion 253 which is bent slightly from the plane of the plate so as to extend at approximately an 85° angle to the axis of the handpiece sleeve 172. The friction lock 250 is also shown in enlarged detail in FIG. 13. As can be seen therein, lock 250 includes a second opening 252. The opening 252 is adapted to receive therethrough the portion 248 of the coupling 170 which extends parallel to the hand grip sleeve 172. The opening 252 is only marginally greater in diameter than the diameter of the tube portion 248. Accordingly, as will be appreciated by those skilled in the art, the periphery of the hole 252 frictionally engages the periphery of the tube portion 248 extending therethrough to lock the vacuum tube coupling 170 in place. When it is desired to remove the vacuum tube coupling from the shroud 168 the tab portion 253 of the friction lock 250 is flexed slightly toward the left shown in FIG. 6 to the position where it extends approximately normally to the longitudinal axis of the portion 248 of the coupling. This action releases the frictional engagement between the opening 252 and the portion 248 to enable the coupling to be slipped out of opening 244 in the shroud and out through the friction lock 250.

The shroud is held in place on the cylindrical cutting head 190, via a shroud locking screw 254. The screw 254 is a threaded member extending through threaded aligned openings 256 and 258 in the shroud and head, respectively. The screw 254 also includes a head portion 260 having an annular groove 262 therein for hanging the cast cutter 160 on a support (not shown).

In accordance with one aspect of the invention the depth of cut produced by the blade 166 of the cast cutter 160 is adjustable. To that end, as can be seen in FIGS. 9–11, stop means 270 are mounted on the end 272 of the shroud adjacent the mouth of the slot 240. The means 270 comprises a flexible band or strip of metal secured to one side 274 of the shroud 168 via pins 276. The strip is flexed about the end 272 and is connected via a pin 278 to the other side of the shroud 168. The strip is an elongated metal member having an elongated slot 282 in its mid-portion and through which the cutting edge 214 of the blade 166 extends. The strip also includes a plurality of key slotted openings 283, disposed a greater distance from pins 276 than the peripheral distance between pins 276 and 278. Each slotted opening 283 is adapted to accommodate the pin 278 therein.

The distance that the blade edge 214 extends through opening 282 is determined by the degree of flexure of the strip 270, i.e., by which of the key openings 283 has the pin 278 disposed therein. For example, with the strip mounted in the manner shown in FIGS. 9 and 11, that is with the pin 278 in the uppermost key slotted opening 283 of the strip, there is the greatest amount of strip flexure and thus exposure of the cutting edge 214 of the blade. The positioning of pin 278 within the lowermost of the key slotted openings 283 results in the least exposure of the cutting edge while the positioning of pin 278 within the intermediate slotted opening 283 results in an intermediate exposure of the cutting edge.

As should be appreciated from the foregoing, the cast cutting embodiment 160 is of wide utility in that it enables the ready replacement of the cutting blade, that adjustment of the length of the stroke of the cutting blade and of the depth of cut. In addition, the device is simple in construction and provides an effective and efficient vacuuming system for extracting the debris produced during the cutting action. The vacuuming means is readily disconnectible from the cutting head to facilitate changing or adjustment of the blade or maintenance of the unit.

Without further elaboration, the foregoing will so fully illustrate my invention that others may, by applying current or future knowledge, readily adapt the same for use under various conditions of service.

What is claimed as the invention is:

1. A combined cutting and vacuum apparatus comprising a cutting device having a vacuum shroud, a remote housing having a vacuum motor disposed therein, a flexible drive shaft powering said cutting device from said motor and a flexible vacuum tube producing a vacuum at said shroud, said motor including a rotary shaft having a first end portion of which an impeller is secured and to which said flexible drive shaft is connected, said housing also including a vacuum chamber mounted over said impeller, with a portion of said rotary shaft extending therethrough, said vacuum chamber having an inlet port laterally offset from said rotary shaft, removable filter means mounted within said housing between said port and said vacuum tube, said cutting device including an abrading bur, said shroud being a tubular member having a free end having a flared mouth, said cutting device being releasably secured by holding means within said shroud with said bur extending from the interior of the free end of the shroud to slightly outside said mouth, said holding means comprising ring means disposed within said shroud surrounding said cutting device and frictionally engaging said cutting device to locate said cutting device centrally in said shroud and engagement means engaging a portion of said cutting device to secure said cutting device at said centrally located position, said shroud including a vacuum tube coupling communicating with the interior of the free end of the shroud and extending at an acute angle thereto to connect said vacuum tube to said shroud so that the vacuum produced by said motor effects the withdrawal of material abraded by the bur into the shroud.

2. The apparatus of claim 1 wherein the ring means comprises at least one O-ring.

3. The apparatus of claim 2 wherein said vacuum tube coupling comprises a tubular extension from said shroud, with the end of said vacuum tube being frictionally fit over the end of said tubular extension.

4. The apparatus of claim 1 wherein said filter means comprises a cannister in which an air pervious filter element is disposed.

5. The apparatus of claim 4 wherein said filter element comprises a bag.

6. A combined cutting and vacuum apparatus comprising a cutting device having a vacuum shroud, a remote housing having a vacuum motor disposed therein, a flexible drive shaft powering said cutting device from said motor and a flexible vacuum tube producing a vacuum at said shroud, said motor including a rotary shaft having a first end portion on which an impeller is secured and to which said flexible drive shaft is connected, said housing also including a vacuum chamber mounted over said impeller, with a portion of said rotary shaft extending therethrough, said vacuum chamber having an inlet port laterally offset from said rotary shaft, removable filter means mounted within said housing between said port and said vacuum tube, said cutting device including a cutting tool, said shroud being a tubular member having a flared open free end, means for frictionally holding said cutting device within said shroud to releasably secure said device within said shroud, with said cutting device extending from the interior of the free end to slightly outside the free end, said means for frictionally holding the cutting device comprising at least one O-ring, said cutting device comprising an abrading bur, said shroud including a vacuum tube coupling communicating with the interior of the free end and extending at an angle thereto to connect said vacuum tube to said shroud so that the vacuum produced by said motor effects the withdrawal of material abraded by said bur into said shroud, through said vacuum conduit and into said filter for entrapment therein.

7. The apparatus of claim 6 wherein said vacuum tube coupling comprises a tubular extension from said shroud, with the end of said vacuum tube being frictionally fit over the end of said tubular extension.

8. A holder and a vacuum shroud for mounting a rotary tool holding handpiece therein, said handpiece including a rotary abrading bur extending therefrom coupled to a source of rotary power, said holder comprising a tubular member having a free end forming a flared mouth, holding means releasably securing said handpiece within the holder, with said abrading bur extending from the interior of the free end of the holder slightly outside the flared mouth thereof, said holding means comprising ring means disposed within said holder surrounding said handpiece and frictionally engaging said handpiece to locate said handpiece centrally in said holder and engagement means engaging a portion of said handpiece to secure said handpiece at said centrally located position, said holder also including a vacuum tube coupling communicating with the interior of the free end of the shroud and extending at an angle thereto, said coupling being adapted to be connected to a vacuum source for drawing in material abraded by the operation of the handpiece.

9. The handpiece holder and vacuum shroud of claim 8 wherein said ring means comprises at least one O-ring disposed within said holder.

10. A holder and vacuum shroud for mounting a rotary tool holding handpiece therein, said handpiece including a rotary abrading bur extending therefrom coupled to a source of rotary power, said holder comprising a tubular member having a flared free end, said handpiece being releasably secured within said holder by friction holding means comprising at least one O-ring disposed within said holder, said abrading bur extending from the interior of the free end of the holder slightly outside thereof, said holder also including a vacuum tube coupling communicating with the interior of the free end of the shroud and extending at an acute angle thereto, said coupling being adapted to be connected to a vacuum source for drawing in the material abraded by the operation of the handpiece.

* * * * *